US010946678B2

(12) United States Patent
Atwood et al.

(10) Patent No.: US 10,946,678 B2
(45) Date of Patent: Mar. 16, 2021

(54) VACUUM TRANSPORT HAVING OPENING PATTERN ALLOWING JETTING OF ALL NOZZLES TO RECEPTACLE

(71) Applicant: Xerox Corporation, Norwalk, CT (US)

(72) Inventors: Christopher D. Atwood, Rochester, NY (US); John R. Uchal, Webster, NY (US); Paul F. Sawicki, Rochester, NY (US); James E. Williams, Penfield, NY (US); Lina Bian, Dracut, MA (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/289,717

(22) Filed: Mar. 1, 2019

(65) Prior Publication Data

US 2020/0276842 A1 Sep. 3, 2020

(51) Int. Cl.

| | |
|---|---|
| ***B41J 2/17*** | (2006.01) |
| ***B41J 2/165*** | (2006.01) |
| ***B41J 13/22*** | (2006.01) |
| ***B41J 2/07*** | (2006.01) |

(52) U.S. Cl.

CPC ..... *B41J 13/226* (2013.01); *B41J 2/07* (2013.01); *B41J 2/16523* (2013.01)

(58) Field of Classification Search

CPC .. B41J 2/16523; B41J 2/1721; B41J 2/16517; B41J 2/1652

See application file for complete search history.

(56) References Cited

U.S. PATENT DOCUMENTS

| | | | | |
|---|---|---|---|---|
| 5,980,018 | A | 11/1999 | Taylor et al. | |
| 6,168,258 | B1 | 1/2001 | Lou et al. | |
| 6,213,583 | B1 | 4/2001 | Therien | |
| 6,318,838 | B1 | 11/2001 | Anderson et al. | |
| 6,340,220 | B1 | 1/2002 | Gaylor et al. | |
| 8,382,242 | B2 | 2/2013 | Rosati et al. | |
| 8,550,592 | B2 * | 10/2013 | Usuda | B41J 11/0065 347/35 |
| 9,004,631 | B1 * | 4/2015 | Folkins | B41J 2/125 347/9 |
| 2007/0236535 | A1 * | 10/2007 | Baker | B41J 2/1721 347/36 |
| 2018/0244045 | A1 * | 8/2018 | Seki | B41J 2/16511 |

* cited by examiner

*Primary Examiner* — Jason S Uhlenhake
(74) *Attorney, Agent, or Firm* — Gibb & Riley, LLC

(57) ABSTRACT

A transport item moves in a process direction to transport sheets of media. The transport item is positioned between an inkjet printhead and a receptacle. The inkjet printhead has nozzles. The transport item has openings arranged in a pattern, the pattern of the openings is consistent along all of the transport item, and the pattern of the openings in the transport item aligns at least one opening with each of the locations of the nozzles as the transport item moves in the process direction. The nozzles eject ink through the openings to the receptacle when the nozzles are aligned with the openings. When controlling the nozzles to eject ink through the openings to the receptacle, a controller can control the nozzles to simultaneously eject ink on a sheet of media while ejecting ink through the openings to the receptacle.

18 Claims, 10 Drawing Sheets

VACUUM TRANSPORT HAVING OPENING PATTERN ALLOWING JETTING OF ALL NOZZLES TO RECEPTACLE

BACKGROUND

Field of the Invention

Systems and methods herein generally relate to vacuum transports for inkjet printers and more particularly to vacuum transports that perform jetting through the belt/drum to a receptacle.

Description of Related Art

Systems herein generally relate to printing devices that have a vacuum belt with perforations and that periodically perform inkjet maintenance jetting.

Vacuum belts are often used to transport sheets of material, such as sheets of paper, plastic, transparencies, card stock, etc., within printing devices (such as electrostatic printers, inkjet printers, etc.). Such vacuum belts have perforations (which are any form of holes, openings, etc., through the belt), that are open to a vacuum manifold through which air is drawn. The vacuum manifold draws in air through the perforations, which causes the sheets to remain on the top of the belt, even as the belt moves at relatively high speeds. The belt is generally supported between two or more rollers (one or more of which can be driven) and are commonly used to transport sheets from a storage area (e.g., paper tray) or sheet cutting device (when utilizing webs of material) to a printing engine.

In addition, printers improve performance by preventing nozzles (jets) of inkjet printheads from clogging. When jets in aqueous inkjet printheads are not used for extended periods, the ink dries out in these jets which interferes with normal operation when the jet needs to be used again.

SUMMARY

Various exemplary devices herein include an inkjet printhead having nozzles. The nozzles are located within the inkjet printhead. These structures also include a transport item (e.g., a vacuum drum or a vacuum belt) adjacent the nozzles. The transport item has openings arranged in a pattern. Also, the transport item is adapted to move in a process direction, and the transport item is shaped to transport sheets of media in the process direction.

These devices also include a receptacle adjacent the transport item and the foregoing structures are positioned such that the transport item is positioned between the inkjet printhead and the receptacle. Additionally, a controller can be electrically connected to the inkjet printhead and the transport item. The pattern of openings in the transport item are consistent along all of the transport item and the openings are aligned other than parallel to the processing direction (e.g., are aligned in rows that are non-parallel to the processing direction).

More specifically, in some embodiments, the openings are uniformly spaced from one another along all of the process direction and along all of a cross-process direction. The pattern of the openings in the transport item aligns at least one opening with each of the locations of the nozzles as the transport item moves in the process direction. Thus, when the nozzles are aligned with the openings, the controller is adapted to (potentially individually) control the nozzles to eject ink through the openings to the receptacle. Also, the size of the openings allows multiple nozzles to simultaneously eject ink through a single opening to the receptacle. The controller can be adapted to control the nozzles to eject the ink through the openings to the receptacle only for nozzles that have not ejected the ink for more than a time limit.

In one example, lateral exposed openings are positioned in a cross-process direction from a location where a sheet is positioned on the transport item (the cross-process direction is perpendicular to the process direction); and the controller can be adapted to control the nozzles to simultaneously eject ink on the sheet while ejecting ink through the lateral exposed openings to the receptacle.

In another example, inter-document gaps are areas between where the sheets of media are positioned on the transport item, and the controller is adapted to control the nozzles to eject ink through the exposed openings in the inter-document gaps to the receptacle, and sometimes simultaneously eject ink on the sheet while ejecting ink through the exposed openings in the inter-document gaps to the receptacle.

Various methods herein move, as controlled by a controller, a transport item in a process direction to transport sheets of media in the process direction. As noted above, the transport item is positioned between an inkjet printhead and a receptacle, the inkjet printhead has nozzles, the nozzles are located within the inkjet printhead, the transport item has openings arranged in a pattern, the openings are aligned other than parallel to the processing direction, the pattern of the openings is consistent along all of the transport item, and the pattern of the openings in the transport item aligns at least one opening of the openings with each of the locations of the nozzles as the transport item moves in the process direction. The openings are uniformly spaced from one another along all of the process direction and along all of the cross-process direction.

Further, these methods control, using the controller, the nozzles to eject ink through the openings to the receptacle when the nozzles are aligned with the openings. When controlling the nozzles to eject ink through the openings to the receptacle, the controller controls the nozzles to eject ink on a sheet of media (potentially simultaneously while ejecting ink through the openings to the receptacle). Thus, when controlling the nozzles to eject ink through the openings to the receptacle, the controller can individually control each of the nozzles to simultaneously eject ink on the sheet while ejecting ink through the lateral exposed openings to the receptacle and/or while ejecting ink through the exposed openings in the inter-document gaps to the receptacle.

Additionally, when controlling the nozzles to eject ink through the openings to the receptacle. The controller controls the nozzles to eject the ink through the openings to the receptacle only for nozzles that have not ejected the ink for more than a time limit. Further, when controlling the nozzles to eject ink through the openings to the receptacle, the controller can control multiple nozzles to simultaneously eject ink through a single opening to the receptacle.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, when jets in aqueous inkjet printheads are not used for extended periods, the ink dries out in these jets, which interferes with normal operation. The problem is exacerbated when the printer is printing on narrow width paper because narrow sheets cause the jets at the edges of printhead to not be used for extended periods. When a print job is then run on wider paper, the jets that have not been used recently may be difficult to recover. For very stubborn jets, the printhead can be removed from the printer and recirculated on a special fixture for many hours, leaving the printer not functional for that time.

Sometimes jets that are located over paper, but not being used for the current image are fired in a random background pattern on each page, and this procedure is sometimes called "sneezing." Sneezing keeps the ink in each jet active but does not help jets outside of the loaded paper size. In view of this, the devices and methods herein allow all jets to sneeze ink, whether located over paper or not, which can eliminate background sneezing of jets onto paper, and thereby prevent waste and image quality problems.

Specifically, with the pattern of vacuum openings in the transport belt or drum, each row of holes is shifted in the cross-process direction by a portion of the hole diameter (e.g., by one-half, one-quarter, one-eighth, etc., of the hole diameter) relative to adjacent holes. Further, the vacuum hole size is made much larger than the spacing of the nozzles, allowing a large window for many adjacent jets to fire through any single hole in the belt/drum. Using the existing belt hole sensor and belt encoder to trigger the start of, and track the position of, the hole pattern allows the printer to know which holes are aligned to which jets at any point in time. Devices herein can use a separate vacuum source located outside of the vacuum transport and with a trap in between. The vacuum trap allows the droplets of ink to be collected and loaded into a waste receptacle for removal by the machine operator.

Devices and methods herein provide a belt hole pattern that allows jetting of any nozzle through the belt to a trap or receptacle to prevent the nozzle from drying out. Also, use of the vacuum trap/receptacle allows the methods and devices herein to capture all ink droplets before they get into the vacuum source.

Figure 1:
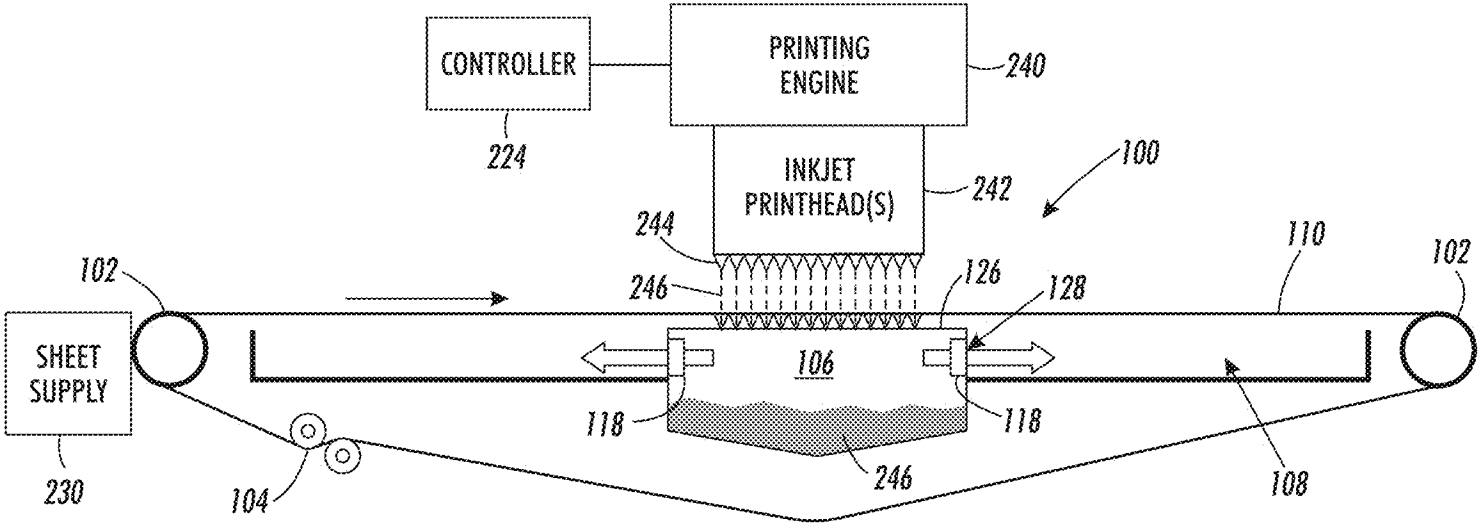
FIGS. 1 and 2 are side-view schematic diagrams illustrating a media path herein.

Therefore, devices herein can be, for example, a printing apparatus (shown in FIG. 7, and discussed in detail below) that can include, among other components (as shown in FIG. 1) a media supply 230 storing print media, a media path 100 having a vacuum belt 110 that includes perforations between the belt edges, and a vacuum manifold 108 positioned adjacent (below) the vacuum belt 110 in a location to draw air through the perforations. As shown in FIG. 1, the vacuum belt 110 is supported between rollers 102, at least one of which is driven, and the belt is kept under proper tension using tensioning rollers 104.

The generic media supply 230 shown in the accompanying drawings can include various elements such as a paper tray, feeder belts, alignment guides, etc., and such devices can store cut sheets, and transport the cut sheets of print media to the vacuum belt 110. Also, a print engine 240 having inkjet printheads 242 with nozzles 244 that eject liquid ink 246 is positioned adjacent the vacuum belt 110 in a location to receive sheets from the vacuum belt 110, and a processor 224 is electrically connected to the print engine 240 and drive rollers 102, etc. FIG. 1 also shows a receptacle 106 adjacent the vacuum belt 110 and the foregoing structures are positioned such that the vacuum belt 110 is positioned between the inkjet printhead 242 and the receptacle 106.

The side of the vacuum belt 110 where the receptacle 106 is located is arbitrarily referred to herein as the "bottom" of the vacuum belt 110, or the area "below" the vacuum belt 110. Conversely, the side of the vacuum belt 110 adjacent where the printhead 242 is located is arbitrarily referred to herein as the "top" of the vacuum belt 110, or the area "above" the vacuum belt 110. However, despite these arbitrary designations, the device itself can have any orientation that is useful for its intended purpose.

The receptacle 106 has at least one opening 126 at its top to allow jetted ink passing through holes in the vacuum belt 110 to enter. The receptacle 106 forms a trap that maintains jetted ink 246 that is ejected through the vacuum belt 110. In one example, the bottom portion of the receptacle 106 can be located below the bottom of (e.g., outside of) the vacuum manifold 108 to help maintain jetted ink within the receptacle 106 (using gravity to keep jetted ink 246 out of the vacuum manifold 108 and associated components).

The portion of the receptacle 106 that is located within the vacuum manifold 108 can optionally include openings 128 that allow air to be drawn from the receptacle 106 (as shown behind the block arrows in FIG. 1). Additionally, air filters 118 can be utilized within such openings 128 to prevent any jetted ink 246 from escaping from the receptacle 106 into the vacuum manifold 108. Therefore, the vacuum applied by the vacuum manifold 108 can help air escape from the manifold 108 but any jetted ink 246 is prevented from reaching the vacuum manifold 108 by the filters 118 and by the shape and location of the receptacle 106 relative to the vacuum manifold 108. The receptacle 106 is removable and can be periodically emptied. Maintaining the jetted ink within the manifold 108 reduces/eliminates the possibility that the vacuum fan or associated structures of the vacuum manifold 108 might become contaminated with ink 246.

Figure 2:
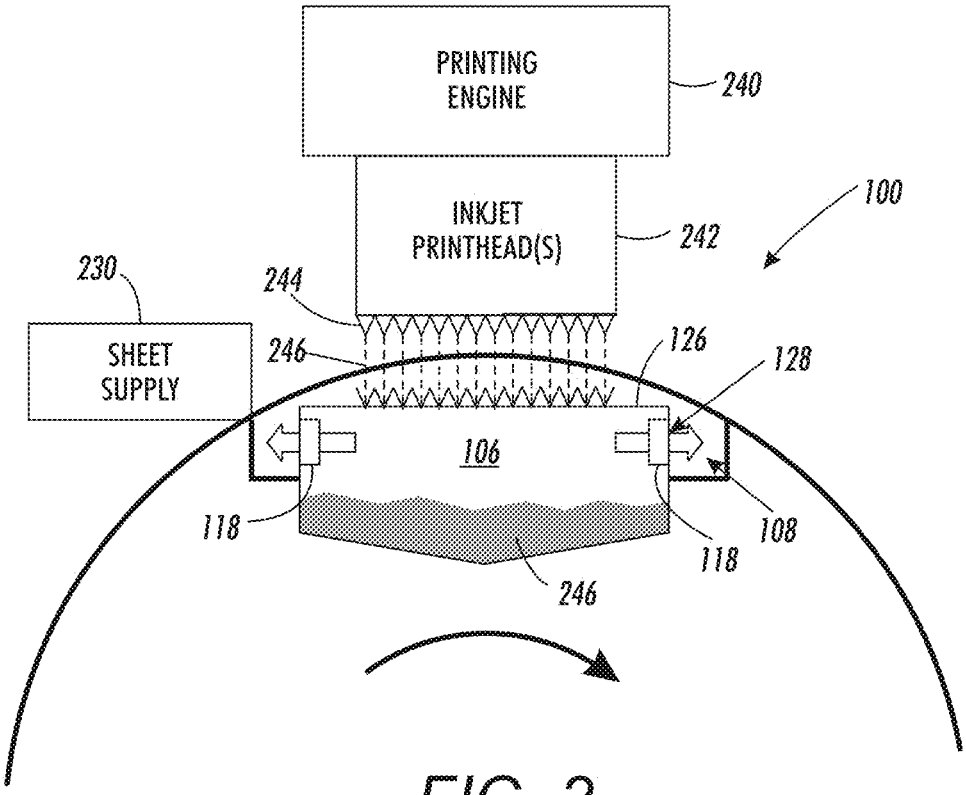

FIG. 2 illustrates a similar printing device structure, with the same components mentioned above identified using the same numbers. However, FIG. 2 illustrates an imaging drum structure 112 that is used in place of the vacuum belt 110. Other that the substitution of the imaging drum structure 112 in place of the vacuum belt 110, the structures are essentially the same. For ease of reference, the vacuum belt 110 and vacuum drum 112 are generically sometimes referred to herein as a "transport item" 110, 112; and the transport item 110, 112 is intended to be any structure that can transport print media past printheads and is, therefore, not limited to only belts and drums (as such are just examples herein) but such can be any transportation device. While FIGS. 1 and 2 shows a side view of the media path 100, FIGS. 3-8 are schematic diagrams illustrating a top view (plan view) of the transport item 110, 112 that is rotated 90° relative to FIGS. 1 and 2.

Figure 3:
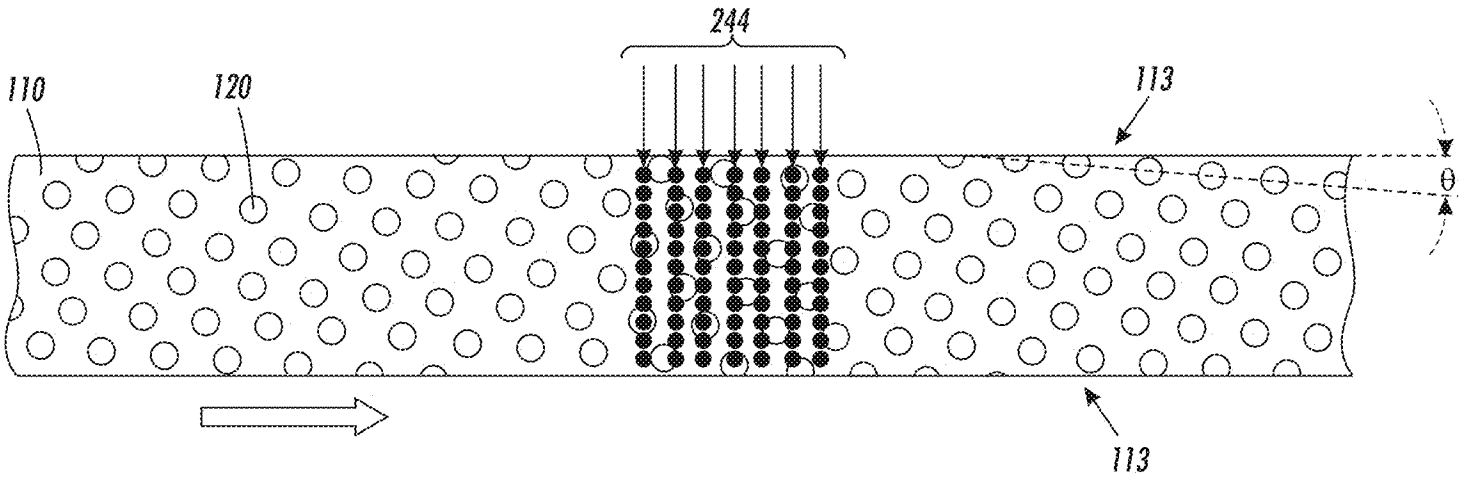
FIGS. 3-8 are top-view schematic diagrams illustrating a vacuum belt herein.

More specifically, FIG. 3 illustrates the top of the transport item 110, 112, holes/perforations that are openings 120 through the transport item 110, 112, belt edges 113, and the processing direction (represented by a block arrow) which is the direction in which the transport item 110, 112 travels. FIG. 3 also shows the nozzles 244 superimposed on the transport item 110, 112 to show the locations of the nozzles 244 relative to the top of the transport item 110, 112.

The dashed line in FIG. 3 shows that the openings 120 are not aligned along a line that is parallel to the processing direction or belt edge 113 (as shown by angle Ø in FIG. 3); and therefore, the openings 120 are aligned in rows that are other than parallel to the processing direction and belt edge 113. Note that the line showing the belt edge 113 in FIG. 3 is extended to help show this non-parallel angle. This angle Ø of alignment of the openings 120 causes the openings 120 in the transport item 110, 112 to align at least one opening 120 with each of the locations of the nozzles 244 at one or more belt locations as the transport item 110, 112 moves in the process direction. Thus, when the transport item 110, 112 is in a position such that nozzles 244 are aligned with openings 120, the controller 224 is adapted to individually control the nozzles 244 to eject ink 246 through the openings 120 to the receptacle 106 (as shown in FIGS. 1 and 2) in a cleaning ejection.

The process of ejecting the ink 246 through the openings 120 to the receptacle 106 is referred to herein as a cleaning ejection or ink jetting. When a nozzle 244 performs a cleaning ejection, the nozzle 244 does not eject the ink 246 to print media, but instead ejects the ink directly to the receptacle 106 through one of the openings 120 within the transport item 110, 112 (without ejecting any ink onto the transport item 110, 112 itself). Cleaning ejections move out ink 246 that has been sitting in the nozzles 244 longer then a non-use time limit and replace the older ink 246 with fresh (new) ink 246. Performing periodic cleaning ejections (e.g., every time the non-use time limit occurs for a given nozzle) helps prevent the ink 246 within the nozzles 244 from drying out and clogging the nozzles 244.

Also, this jetting can be controlled to occur only for nozzles 244 that have not ejected ink for longer than the non-use time limit, or at specific sheet counts (e.g., after every N sheets). Additionally, the non-use time limit can be different intervals for different type inks or different colors. Therefore, with devices and methods herein, nozzles 244 within the printheads 242 can be individually selectively jetted only after an idle time period or sheet count (during which the nozzles 244 do not eject the liquid ink) has expired, which can be different for different inks or colors, etc. Such can also be different on a nozzle-by-nozzle basis depending upon which nozzles 244 were used or not used in recent print job operations. In print job operations, the ink 246 is printed on print media in a pattern according to a print job to produce an item of printer output, which is contrasted with jetting printing that occurs through the openings 120 to the receptacle 106.

Figure 4:
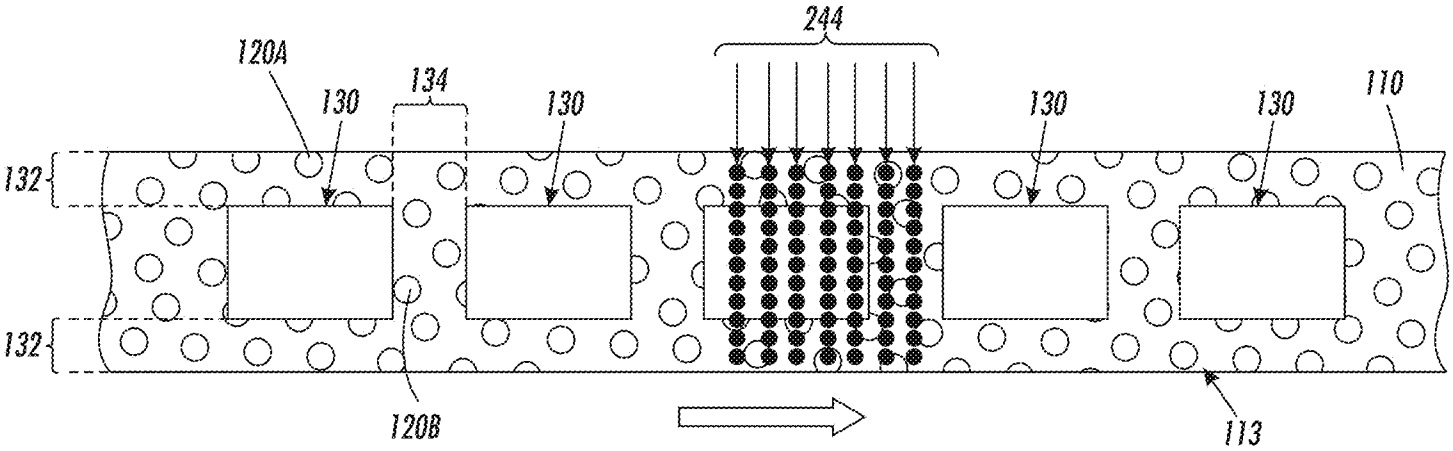

FIG. 4 shows the same structure as is shown in FIG. 3; however, in FIG. 4 some exemplary sheets of print media 130 are shown positioned on the top of the transport item 110, 112. Therefore, as shown in FIG. 4, the transport item 110, 112 is adapted to move in a process direction, and the transport item 110, 112 is shaped to transport sheets of media 130 in the process direction.

FIG. 4 also illustrates that the sheets of media 130 can be less wide (narrower) than the transport item 110, 112, which leaves uncovered lateral spaces 132 between the edges of the media 130 and the belt edges 113 (in the cross-process direction that is perpendicular to the process direction). Similarly, the sheets of media 130 can be arranged on the transport item 110, 112 to leave a space or gap between the sheets of media 130 (e.g., inter-document zone (IDZ) or inter-document gap 134). Thus, in one example, lateral exposed openings 120A in the lateral spaces 132 are positioned in a cross-process direction from a location where a sheet (of the sheets of media) is positioned on the transport item 110, 112. If such lateral spaces 132 exist, the controller 224 can be optionally adapted to control the nozzles 244 to eject ink 246 on the sheet of media 130 to perform printing of a print job operation while simultaneously ejecting ink 246 through the lateral exposed openings 120A in the lateral spaces 132 to the receptacle 106 (to simultaneously perform a print job operation and jetting).

In another example, if inter-document gaps 134 are present, the controller 224 is adapted to control the nozzles 244 to eject ink 246 through the exposed openings 120B in the inter-document gaps 134 to the receptacle 106, and sometimes simultaneously eject ink 246 on the leading/trailing edges of sheet of media 130 (in a print job operation) while ejecting ink 246 through the exposed openings 120B in the inter-document gaps 134 to the receptacle 106 (to again simultaneously perform a print job operation and jetting).

Further, the pattern of the openings 120 in the transport item 110, 112 is uniform (the same, consistent, without break or interruption, etc.) along all of the transport item 110, 112 (but not aligned in the process direction). More specifically, in some embodiments, the openings 120 are uniformly spaced from one another along all of the process direction and along all of a cross-process direction, without necessarily being aligned in the process direction.

In other words, the transport item 110, 112 does not include restricted zones that are dedicated for only jetting use in which each of the openings 120 in such restricted zones are specifically aligned with a given nozzle 244 (e.g., where there are multiple patterns of openings along the length of the transport item 110, 112: one for printing and one for jetting). Instead, in the structures herein, the transport item 110, 112 has a single, continuous pattern of the openings 120 along its full length. This allows any of the openings 120 along the entire belt/drum to be used for jetting (e.g., when a given opening 120 is aligned with at least one of the nozzles 244 at some point during the movement of the transport item 110, 112 in the processing direction). This allows the nozzles 244 that are located in the lateral spaces 132 or the inter-document gap 134 to be periodically actuated, without affecting (and without needing coordination with) the nozzles 244 that are printing a print job on the print media 130.

Often the nozzles 244 that are located in the lateral spaces 132 are nozzles 244 that do not eject ink 246 regularly, resulting in such nozzles 244 clogging more often. As noted above, performing periodic individual nozzle cleaning ejections/jetting (e.g., every time the non-use time limit is exceeded for a given nozzle 244) helps prevent the ink 246 within the nozzles 244 from drying out and clogging the nozzles 244. Therefore, with the structures and methods herein, cleaning ejections can be performed individually for any nozzle 244 whenever needed for that given nozzle 244 (so long as that nozzle is not positioned over a sheet of print media 130 and that nozzle is located over one of the openings 120 in the transport item 110, 112). Again, the controller 224 can be adapted to control the nozzles 244 to eject the ink 246 through the openings 120 to the receptacle only for nozzles 244 that have not ejected the ink 246 for more than the non-use time limit.

In contrast, if only a limited, dedicated portion of the transport item 110, 112 was available for cleaning ejections, the cleaning ejection process would have to be separated from print job operations, adding complication and possible unnecessary delay. Further, using a limited portion of the transport item 110, 112 for cleaning ejections may create larger inter-document zones than would otherwise be utilized for a given printing device, decreasing printer throughput.

Figure 5:
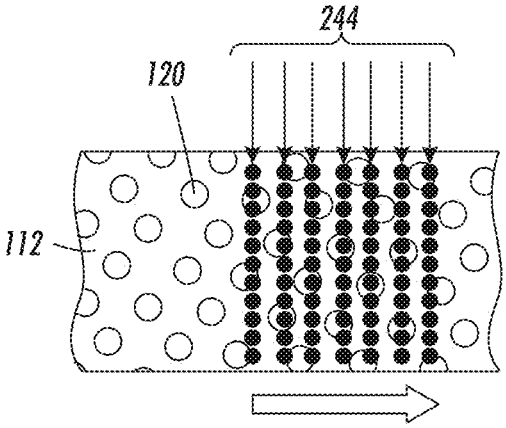
Figure 6:
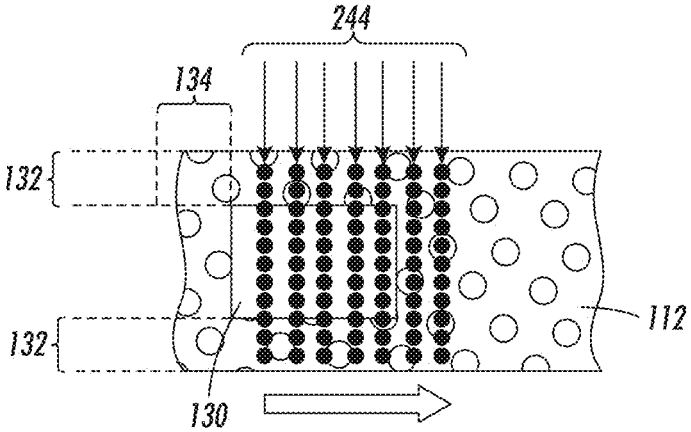

FIGS. 5 and 6 show the same elements discussed above for the imaging drum 112 embodiment (instead of the vacuum belt 110 example shown in FIGS. 3 and 4). Therefore, as shown in FIGS. 5 and 6, similarly the full length, single, continuous pattern of the openings 120 of the imaging drum 112 allows any of the openings 120 along the entire imaging drum 112 to be aligned with at least one of the nozzles 244 at some point during the movement/rotation of the imaging drum 112 in the processing direction to allow all nozzles to be individually periodically actuated, without affecting (and without needing coordination with) the nozzles 244 that are printing print jobs on the print media 130.

Figure 7A:
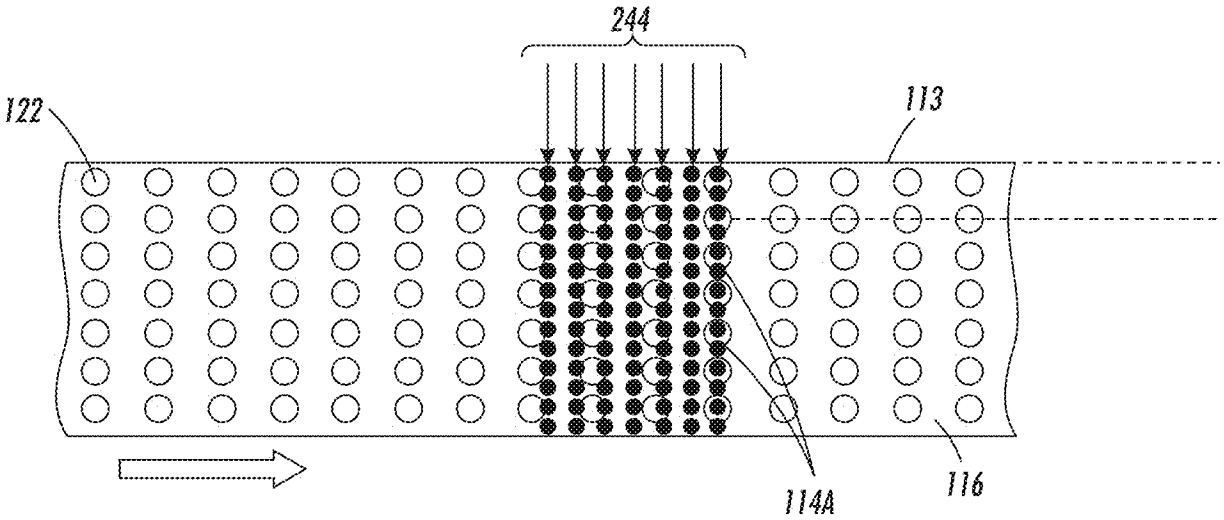
Figure 7B:
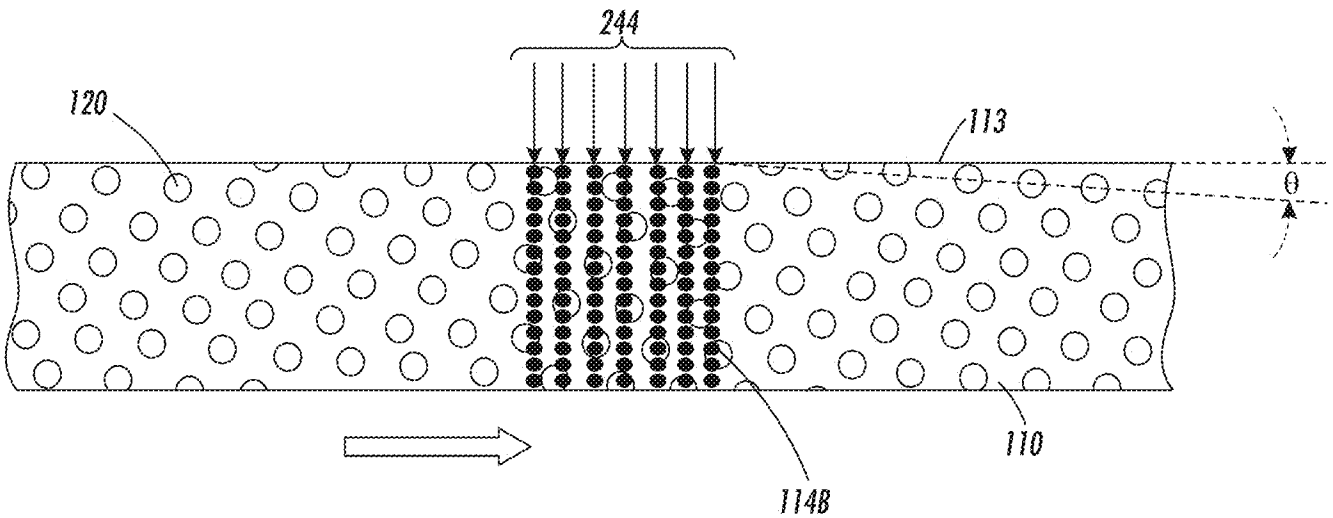

FIG. 7A illustrates a vacuum belt 116 having openings 122 that are arranged parallel to the processing direction and belt edge 113, as shown by the guideline intersecting the openings 122. In contrast, the transport item 110, 112 shown in FIG. 3 is reproduced in FIG. 7B. As pointed to by arrows 114B in FIG. 7B, all of the locations of the nozzles 244 intersect one or more of the openings 120 at some point during the full rotation/movement of the transport item 110, 112; while, in contrast, in FIG. 7A arrows 114A point to locations of nozzles 244 that will never intersect any of the openings 122 during any rotation of the transport item 110, 112 because the gaps between the openings 122 are similarly parallel to the processing direction and belt edge 113. In other words, the parallel-to-processing direction alignment of openings 122 in FIG. 7B leaves spacing between the openings 122 that is also parallel to the processing direction which causes any nozzles that are aligned with such spacing to never be able to execute cleaning ejections to the receptacle 106. In contrast, because the openings 120 of the transport item 110, 112 are not aligned parallel to the processing direction (and belt edge 113) the nozzles 244 will always intersect one or more of the openings 120 (at some point of the transport item 110, 112 movement relative to the printheads 242).

Figure 8:
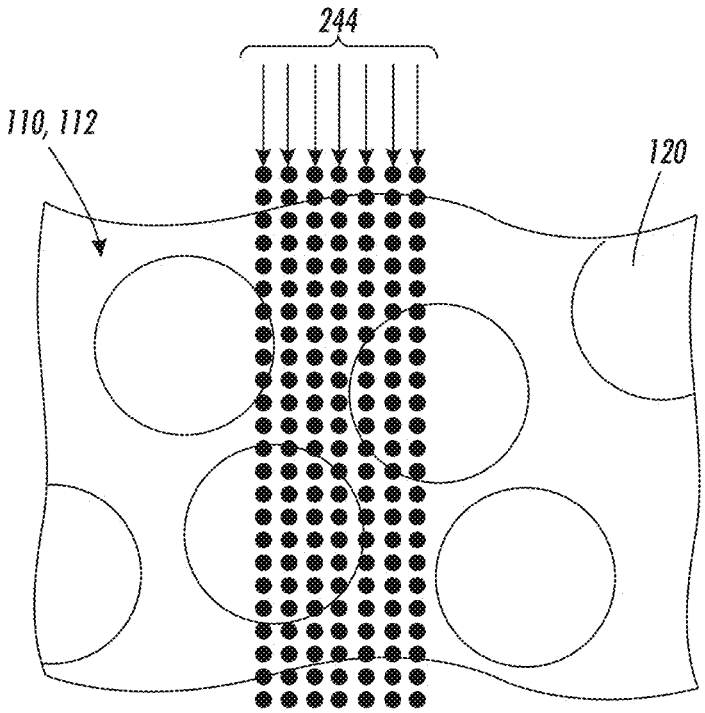

As shown in the expanded view of a portion of the transport item 110, 112 in FIG. 8, the size of the openings 120 can be at least twice as big as the droplets of ink 246 ejected by the nozzles 244 (and can be 10 times, 100 times, etc., as big) to allow multiple nozzles 244 to simultaneously eject ink 246 through a single opening 120 to the receptacle 106.

Figure 9:
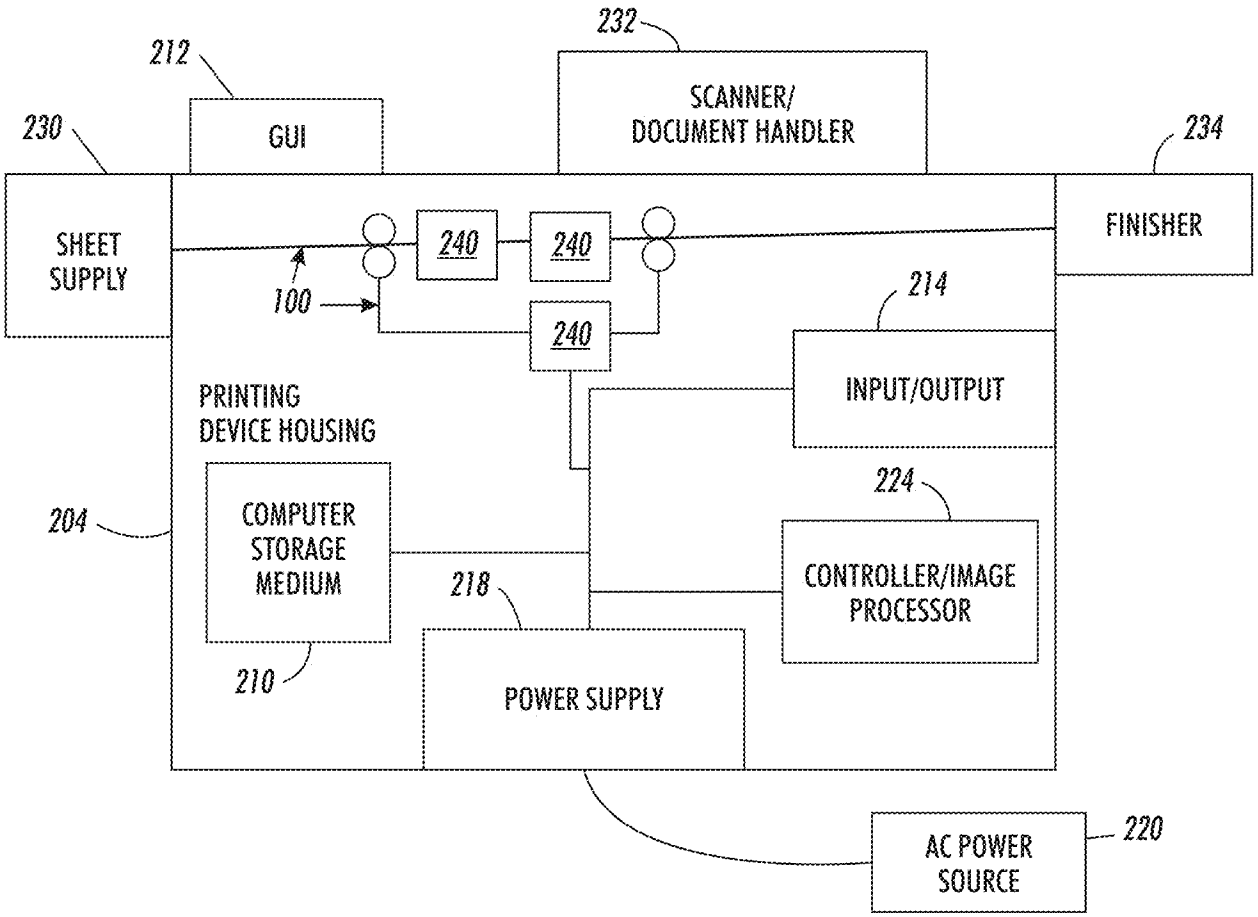
FIG. 9 is a schematic diagram illustrating printing devices herein.

FIG. 9 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 9, a body housing has one or more functional components that operate on power supplied from an alternating current (AC) source 220 by the power supply 218. The power supply 218 can comprise a common power conversion unit, power storage element (e.g., a battery, etc.), etc.

The printing device 204 includes at least one marking device (printing engine(s)) 240 that use marking material, and are operatively connected to a specialized image processor 224 (that is different from a general purpose computer because it is specialized for processing image data), a media path 100 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies marking material (toner, inks, plastics, organic material, etc.) to continuous media, sheets of media, fixed platforms, etc., in two- or three-dimensional printing processes, whether currently known or developed in the future.

Figure 10:
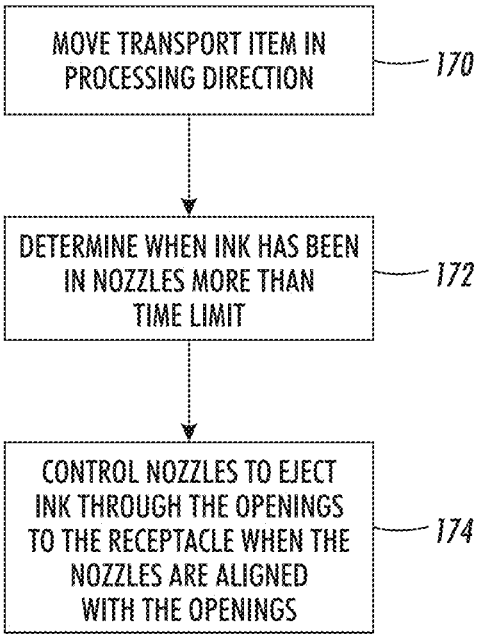
FIG. 10 is a flowchart illustrating methods herein.

FIG. 10 is a flowchart showing that methods herein move, as controlled by a controller, a transport item in a process direction (in item 170) to transport sheets of media in the process direction. As noted above, the transport item is positioned between an inkjet printhead and a receptacle, the inkjet printhead has nozzles, the nozzles are located within the inkjet printhead, the transport item has openings arranged in a pattern, the openings are aligned in rows that are other than parallel to the processing direction, the pattern of the openings is consistent along all of the transport item, and the pattern of the openings in the transport item aligns at least one opening of the openings with each of the locations of the nozzles as the transport item moves in the process direction relative to the printheads. The openings can be uniformly spaced from one another along all of the process direction and along all of the cross-process direction.

Further, in item 172, these methods determine, for each individual nozzle, whether ink has not been ejected from that nozzle for more than the non-use time limit (either for printing ejections or jetting ejections). As noted above, performing periodic cleaning ejections (e.g., every time the non-use time limit is exceeded for a given nozzle) helps prevent the ink within the nozzles from drying out and clogging the nozzles. Also, this jetting can be controlled to occur for all nozzles at specific sheet counts (e.g., after every N sheets) or only for nozzles that have not ejected ink for longer than a non-use time limit. This non-use time limit can be different intervals for different type inks or different ink colors.

Therefore, in item 172, these methods record the time when each of the nozzles last ejected ink to determine how long it has been since each nozzle ejected ink, and then this elapsed time is compared to the non-use time limit to determine whether the ink within a given nozzle has been in that nozzle for more than the non-use time limit and a jetting ejection into the receptacle needs to be performed.

If ink has been in a nozzle for more than the non-use time limit, in item 174, these methods perform a cleaning ejection/jetting on that nozzle, where the cleaning ejection involves ejecting ink through one of the openings to the receptacle. More specifically, in item 174, these methods control, using the controller, the nozzles to eject ink through the openings to the receptacle when the nozzles are aligned with the openings.

When controlling the nozzles to eject ink through the openings to the receptacle in item 174, the controller can control the nozzles to perform print job operations by ejecting ink on a sheet of media while simultaneously ejecting ink through the openings to the receptacle. Thus, when controlling the nozzles to eject ink through the openings to the receptacle, the controller can control the nozzles to simultaneously eject ink on the sheet while ejecting ink through the lateral exposed openings or openings in the inter-document gaps to the receptacle.

Therefore, when controlling the nozzles to eject ink through the openings to the receptacle in item 174, the controller individually controls the nozzles to eject the ink through the openings to the receptacle only for nozzles that have not ejected the ink for more than a time limit (as determined in item 172). Further, when controlling the nozzles to eject ink through the openings to the receptacle in item 174, the controller can control multiple nozzles to simultaneously eject ink through a single opening to the receptacle.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. Additionally, terms such as "adapted to" mean that a device is specifically designed to have specialized internal or external components that automatically perform a specific operation or function at a specific point in the processing described herein, where such specialized components are physically shaped and positioned to perform the specified operation/function at the processing point indicated herein (potentially without any operator input or action). In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A device comprising:

an inkjet printhead having nozzles;

a transport item adjacent the nozzles, wherein the transport item has openings and moves in a processing direction, wherein the openings are spaced along a cross-process direction that is perpendicular to the process direction such that a pattern of the openings in the transport item aligns at least one opening of the openings with each of the locations of the nozzles as the transport item moves in the process direction, and; and a receptacle adjacent the transport item, wherein the transport item is positioned between the inkjet printhead and the receptacle, wherein the pattern of the openings is consistent along all of the transport item, wherein the openings are aligned other than parallel to the processing direction, and wherein the pattern of the openings allows the nozzles to simultaneously eject ink on a sheet of media while ejecting ink through the openings to the receptacle without ejecting any ink onto the transport item.

2. The device according to claim 1, further comprising a controller electrically connected to the inkjet printhead and the transport item, wherein the controller is adapted to control the nozzles to simultaneously eject ink on the sheet of media while ejecting ink through the openings to the receptacle.

3. The device according to claim 1, further comprising a controller electrically connected to the inkjet printhead and the transport item, wherein lateral exposed openings of the openings are positioned in the cross-process direction from a location where the sheet of media is positioned on the transport item, and wherein the controller is adapted to control the nozzles to simultaneously eject ink on the sheet of media while ejecting ink through the lateral exposed openings to the receptacle.

4. The device according to claim 1, wherein a size of the openings allows multiple ones of the nozzles to simultaneously eject ink through a single opening, of the openings, to the receptacle.

5. The device according to claim 1, wherein the receptacle includes openings to a vacuum manifold, wherein the openings include air filters, and wherein a shape and position of the receptacle and the air filters prevent the ink from passing into the vacuum manifold.

6. The device according to claim 1, further comprising a controller electrically connected to the inkjet printhead and the transport item, wherein the controller is adapted to control the nozzles to eject the ink through the openings to the receptacle only for nozzles that have not ejected the ink for more than a time limit.

7. The device according to claim 1, wherein the transport item comprises a vacuum drum or a vacuum belt.

8. A device comprising:

an inkjet printhead having nozzles, wherein the nozzles are at locations within the inkjet printhead;

a transport item adjacent the nozzles, wherein the transport item has openings arranged in a pattern, wherein the transport item is adapted to move in a process direction, and wherein the transport item is shaped to transport sheets of media in the process direction;

a receptacle adjacent the transport item, wherein the transport item is positioned between the inkjet printhead and the receptacle; and a controller electrically connected to the inkjet printhead and the transport item, wherein the pattern of the openings is consistent along all of the transport item, wherein the openings are aligned other than parallel to the processing direction, wherein the openings are spaced along a cross-process direction that is perpendicular to the process direction such that the pattern of the openings in the transport item aligns at least one opening of the openings with each of the locations of the nozzles as the transport item moves in the process direction, and wherein the pattern of the openings allows the controller to control the nozzles to simultaneously eject ink on one of the sheets of media while ejecting ink through the openings to the receptacle without ejecting any ink onto the transport item.

9. The device according to claim 8, wherein lateral exposed openings of the openings are positioned in the cross-process direction from a location where a sheet of the sheets of media is positioned on the transport item, and wherein the controller is adapted to control the nozzles to simultaneously eject ink on the sheet while ejecting ink through the lateral exposed openings to the receptacle.

10. The device according to claim 8, wherein a size of the openings allows multiple ones of the nozzles to simultaneously eject ink through a single opening, of the openings, to the receptacle.

11. The device according to claim 8, wherein the receptacle includes openings to a vacuum manifold, wherein the openings include air filters, and wherein a shape and position of the receptacle and the air filters prevent the ink from passing into the vacuum manifold.

12. The device according to claim 8, wherein the controller is adapted to control the nozzles to eject the ink through the openings to the receptacle only for nozzles that have not ejected the ink for more than a time limit.

13. The device according to claim 8, wherein the transport item comprises a vacuum drum or a vacuum belt.

14. A method comprising:

moving, as controlled by a controller, a transport item in a process direction to transport sheets of media in the process direction, wherein the transport item is positioned between an inkjet printhead and a receptacle, wherein the inkjet printhead has nozzles, wherein the nozzles are at locations within the inkjet printhead, wherein the transport item has openings arranged in a pattern, wherein the openings are spaced along a cross-process direction that is perpendicular to the process direction such that the openings are aligned other than parallel to the processing direction, wherein the pattern of the openings is consistent along all of the transport item, and wherein the pattern of the openings in the transport item aligns at least one opening of the openings with each of the locations of the nozzles as the transport item moves in the process direction; and controlling, by the controller, the nozzles to simultaneously eject ink on one of the sheets of media while ejecting ink through the openings to the receptacle without ejecting any ink onto the transport item as allowed by the pattern of the openings.

15. The method according to claim 14, wherein lateral exposed openings of the openings are positioned in the cross-process direction from a location where a sheet of the sheets of media is positioned on the transport item, and wherein when controlling the nozzles to eject ink through the openings to the receptacle, the controller controls the nozzles to simultaneously eject ink on the sheet while ejecting ink through the lateral exposed openings to the receptacle.

16. The method according to claim 14, wherein when controlling the nozzles to eject ink through the openings to the receptacle, the controller controls multiple ones of the nozzles to simultaneously eject ink through a single opening, of the openings, to the receptacle.

17. The method according to claim 14, wherein the receptacle includes openings to a vacuum manifold, wherein the openings include air filters, and wherein a shape and position of the receptacle and the air filters prevent the ink from passing into the vacuum manifold.

18. The method according to claim 14, wherein when controlling the nozzles to eject ink through the openings to the receptacle, the controller controls the nozzles to eject the ink through the openings to the receptacle only for nozzles that have not ejected the ink for more than a time limit.

* * * * *